US005261363A

United States Patent [19]

Kemnitz

[11] Patent Number: 5,261,363

[45] Date of Patent: Nov. 16, 1993

[54] PISTON WITH SEPARATE HEAD AND SKIRT

[75] Inventor: Peter Kemnitz, Kernen, Fed. Rep. of Germany

[73] Assignee: Mahle GmbH, Stuttgart, Fed. Rep. of Germany

[21] Appl. No.: 28,257

[22] Filed: Mar. 9, 1993

[30] Foreign Application Priority Data

Mar. 13, 1992 [DE] Fed. Rep. of Germany ..... 4208037

[51] Int. Cl.[5] ..... F02F 3/00

[52] U.S. Cl. ..... 123/193.6; 123/41.35; 92/186; 29/888.044

[58] Field of Search ..... 123/41.34, 41.35, 193.6; 92/186, 255; 29/888.04, 888.042, 888.044

[56] References Cited

U.S. PATENT DOCUMENTS 4,843,698 7/1989 Ripberger et al. ..... 29/888.042
4,986,167 1/1991 Stratton et al. ..... 123/193.6

FOREIGN PATENT DOCUMENTS

252638A1 12/1987 Fed. Rep. of Germany .
3643039A1 6/1988 Fed. Rep. of Germany .
4134530A1 5/1992 Fed. Rep. of Germany .
4039752A1 6/1992 Fed. Rep. of Germany .

*Primary Examiner*—Noah P. Kamen
*Attorney, Agent, or Firm*—Collard & Roe

[57] ABSTRACT

The invention relates to a piston for an internal combustion engine. The piston has a longitudinally extending axis and ring grooves for receiving piston rings, and a separate piston head having a top and an annular cooling oil duct. A ring belt extends downwardly from the top of the piston head to define an outer border of the annular cooling oil duct and forms a first support facing in an axial direction. Bosses define an inner border of the annular cooling oil duct and form a second support facing in an opposite axial direction. The cooling oil duct has an opening and an annular plate supported on the first and second supports by spring tension. The annular plate closes the opening of the annular cooling oil duct to retain oil therein to cool the piston.

10 Claims, 2 Drawing Sheets

PISTON WITH SEPARATE HEAD AND SKIRT

BACKGROUND OF THE INVENTION

1. Field of the Invention

The present invention relates to an oil-cooled piston for an internal combustion engine. More particularly, the invention relates to a piston having an annular plate covering an annular cooling oil duct in the piston head.

2. The Prior Art

Pistons are known from German patent Nos. DD 252 638 Al and DE 41 34 530 Al, in which an annular plate in the form of an open sheet metal ring covers the cooling oil duct. These rings are supported either in a groove on the inside of the ring belt or the outside of the central annular rib of the piston. The rings are subjected to elastic deformation according to the Seeger ring principle; that is, they are initially stressed in the radial direction.

However, the rings according to these references cannot be used with pistons having a large piston pin diameter and correspondingly large piston pin bosses. With large piston pin diameters, installation of the annular plate is problematic to an extent that the annular plate cannot be used at all or can only be used to partially cover the cooling oil space.

A cooled piston with a separate head and skirt is known from German patent No. DE 40 39 752 Al having an annular hollow space in the piston head for receiving cooling oil. The lower part of the annular hollow space is sealed by a sheet metal ring that may consist of two separate parts. The inner periphery of the sheet metal ring is provided with a collar which rests against the rib of the piston head. The outer periphery of the sheet metal ring rests on the piston skirt which flexes the sheet metal ring upward and is then coupled to the piston head by the piston pin bushings. A disadvantage of this design is that the sheet metal ring is supported by both the piston head and the piston skirt.

German patent No. DE 36 43 039 Al discloses a sheet metal ring divided into two halves for sealing the lower portion of an annular cooling oil space in the piston head of a multi-part cooled piston. The sheet metal ring is fastened to the piston head by a flanged collar that extends from the inner surface of the ring belt. The sheet metal ring can also be attached by welding, soldering or screwing the sheet metal ring to the ring belt. This design presents numerous disadvantages in that it is expensive to manufacture and additional fastening elements are required to attach the sheet metal ring to the piston head.

SUMMARY OF THE INVENTION

The principal object of the invention is to provide an oil-cooled piston of simple structure which functions efficiently, effectively and reliably.

An object of the invention is to provide a cooled piston which overcomes the drawbacks of the prior art and has an annular plate that simply covers the annular cooling oil duct.

Another object of the invention is to provide a piston with an annular plate which is held in place by axial spring tension against two supports of the piston head.

Still another object of the invention is to provide a piston having an annular plate which is installed with facility, ease and convenience to cover the annular cooling oil duct.

These and other related objects are achieved according to the invention by an oil-cooled piston for an internal combustion engine. The piston has a longitudinally extending axis, ring grooves for receiving rings, a separate head and a skirt joined to the head by a pin. The piston head has a top, an annular cooling oil duct and a ring belt that extends downwardly from the top of the piston head to define an outer border of the annular cooling oil duct and forms a first support facing in an axial direction. The piston head also has bosses that define an inner border of the annular cooling oil duct and form a second support facing in an opposite axial direction. The cooling oil duct is open in the axial direction facing the skirt. An annular plate is supported on the first and second supports by spring tension. The annular plate closes the opening of the annular cooling oil duct to retain cooling oil therein to cool the piston.

The ring belt includes a lower free end facing in an axial direction toward the skirt with a recess therein defining the first support. The second support includes an annular step extending around the circumference of the bosses facing in an axial direction toward the top of the piston head. The annular plate spring consists of at least two parts, especially two semiannular parts. The annular plate spring includes an outer edge supported in the recess and an inner edge supported on the step. The annular plate is made of resilient material and exerts axial force against the recess and the step.

The invention further provides a method for closing an annular cooling oil duct in a piston with a longitudinally extending axis for an internal combustion engine having a separate head, with a top end and a skirt joined by a pin. The steps include providing a piston head with a first support, facing in an axial direction, recessed in a free end of a downwardly extending ring belt and a second support facing in an opposite axial direction located on the piston head bosses. The outer edge of a semiannular plate is placed on the free end of the ring belt. The inner edge of the plate is pushed past the bosses to a position on the second support. The outer end of the plate is snapped under axial tension onto the first support. The steps of placing the outer edge, pushing an inner edge and snapping the outer edge are repeated with a second semiannular plate, so that the annular cooling oil duct is closed to retain the cooling oil therein to cool the piston.

BRIEF DESCRIPTION OF THE DRAWINGS

Other objects and features of the present invention will become apparent from the following detailed description considered in connection with the accompanying drawings which disclose an embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
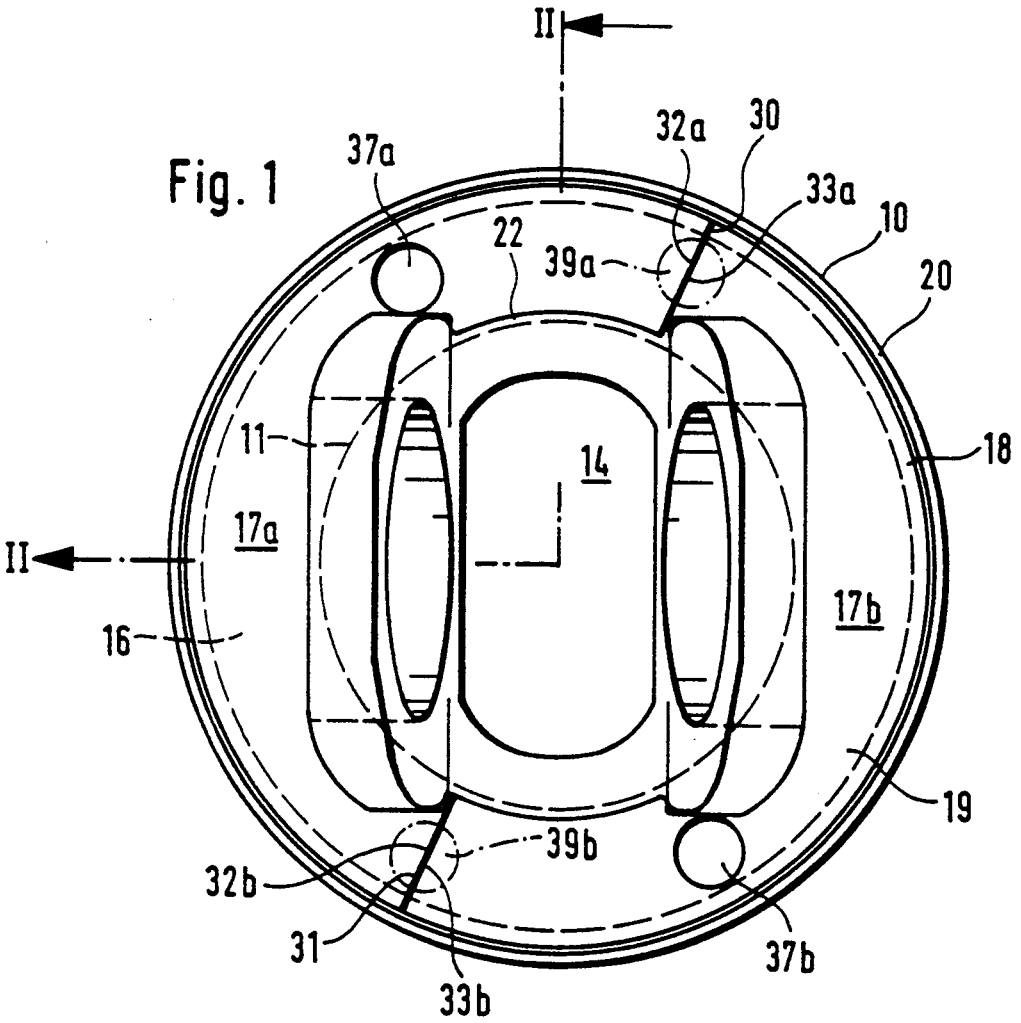
FIG. 1 is a bottom view of a piston head and annular plate of the piston of the invention.
Figure 2:
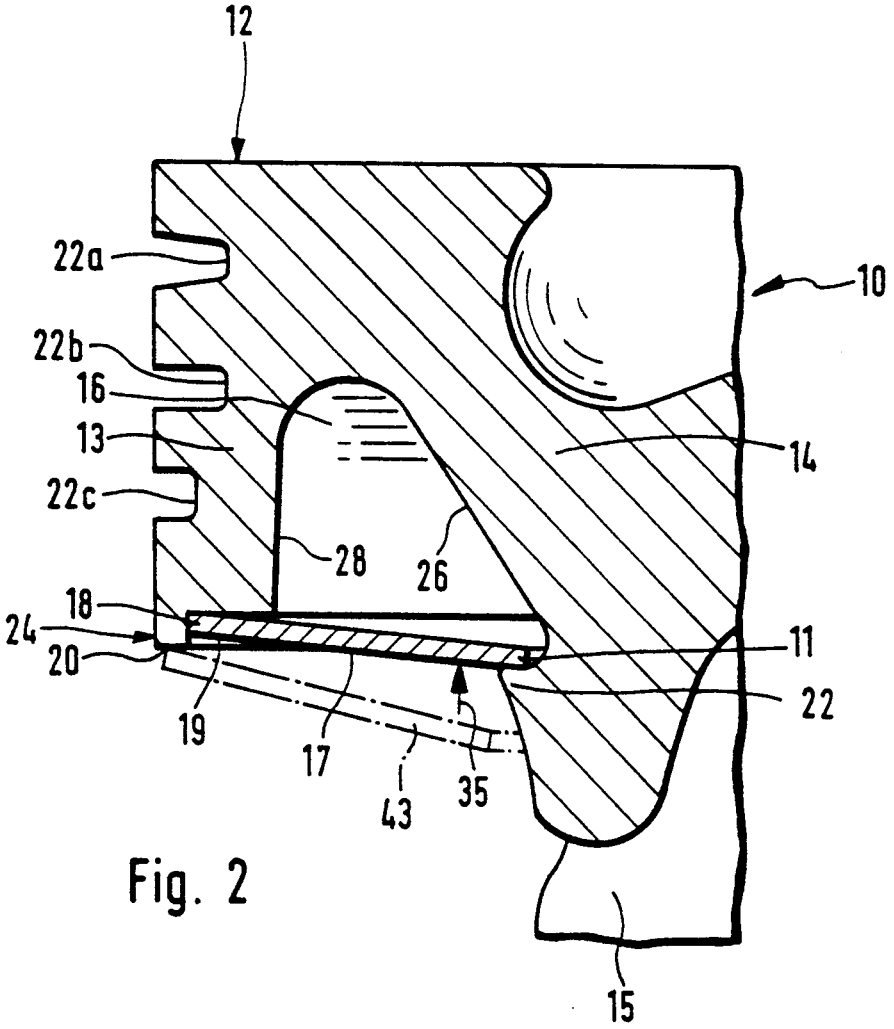
FIG. 2 is a cross-sectional view taken along line II—II from FIG. 1.

Referring now to the drawings and in particular to FIGS. 1 and 2, there is shown a piston head 10 forming part of an articulated, jointed or multipart piston having a piston skirt coupled to said piston head by a piston pin or gudgeon pin. The skirt and pin are not shown in the FIGS. for the sake of clarity. An outer annular wall or ring belt 13 includes grooves 22*a*, 22*b* and 22*c* for receiving piston rings (which are not shown for the sake of clarity). Ring belt 13 extends from top 12 of piston head 10 and terminates in a lower free end 24. An annular rib 14 is designed as an inner support and connects piston bosses 15 with top end 12. Annular rib 14 defines the inner border 26 of an annular cooling oil duct 16. The inner wall of ring belt 13 defines outer border 28 of annular cooling oil duct 16. Annular cooling oil duct 16 is open in the axial direction facing bosses 15 and the piston skirt, or away from top 12.

Free end 24 includes a lower face side 20 which faces in a direction away from top 12 or toward the piston skirt. Lower face side 20 is provided with a rectangular cross-sectional recess 19 that extends around the circumference of piston head 10. Annular rib 14 is provided with a step 22 which extends radially outward from said annular rib and encircles said annular rib.

An annular plate, or plate spring 17, which is substantially resilient, has an outer edge 18 and an inner edge 11. Annular plate 17 closes the opening of the annular cooling oil duct 16 in order to retain cooling oil therein to cool the piston. Plate 17 is divided along a radius 30 extending from its inner edge 11 to its outer edge 18 and a second radius 31 extending radially from its inner edge 11 to its outer edge 18. Divisions 30 and 31 may be located on opposite sides of the central piston axis to divide plate 17 into two semiannular parts 17*a* and 17*b* and may lie on a diameter. Plate part 17*a* has radial edges 32*a* and 32*b* which face edges 33*a* and 33*b* of plate part 17*b* to form a complete annular plate spring 17 when installed in piston head 10.

Semiannular plates 17*a* and 17*b* are installed in piston head 10 by placing semiannular plate 17*a*, for example, a resting position 43, shown in phantom lines in FIG. 2. Outer edge 18 of semiannular plate 17*a* rests against lower face side 20 and extends radially beyond recess 19, as shown in FIG. 2. Inner edge 11 is forced axially upward in a direction 35, beyond circular step 22, so that said inner edge comes to rest on said step, as shown in solid line in FIG. 2. The transition from resting position 43 to the position above step 22 prestresses semiannular plate part 17*a*, so that outer edge 18 snaps past lower face side 20 into recess 19. The axial tension exerted by semiannular plate 17*a* axially wedges said semiannular plate between recess 19 and step 22. The semiannular spring 17*b* is then installed in a similar manner on the remaining open side of annular hollow space 16.

Cooling oil is then supplied to annular cooling space 16 through a bore 37*a* in semiannular plate 17*a* and is discharged through bore 37*b* in plate 17*b*, as shown in FIG. 2. Alternatively, cooling oil can be supplied to annular cooling space 16 through a bore 39*a* and can be discharged through a bore 39*b*. Each of the bores 39*a* and 39*b*, as shown in FIG. 1, in phantom line, is formed through both semiannular plates 17*a* and 17*b* jointly at the edges 32*a*, 33*a*, 32*b* and 33*b*.

Annular plate 17 can be advantageously used with articulated pistons to simply close the annular cooling oil ducts. By closing the cooling oil ducts, cooling oil can be fed into the cooling oil duct and circulated throughout the cooling oil duct to cool the piston before being discharged. The snap fit installation of the semiannular plates 17*a* and 17*b* permits the piston head to be simply constructed without requiring additional materials or fasteners.

While only a single embodiment of the present invention have been shown and described, it is to be understood that many changes and modifications may be made thereunto without departing from the spirit and scope of the invention as defined in the appended claims.

What is claimed is:

1. An oil-cooled piston for an internal combustion engine, said piston having a longitudinally extending axis and ring grooves for receiving piston rings and a separate piston head having a top and an annular cooling oil duct, said piston head comprising:

a ring belt extending downwardly from the top of said piston head to define an outer border of said annular cooling oil duct and forming a first support facing in an axial direction;

bosses defining an inner border of said annular cooling oil duct and forming a second support facing in an opposite axial direction, said cooling oil duct having an opening; and an annular plate radially divided into two parts and supported on said first and second supports by axial spring tension in a manner whereby said annular plate closes the opening of said annular cooling oil duct to retain oil therein to cool the piston, wherein said annular plate is made from a substantially resilient material.

2. The oil-cooled piston according to claim 1, wherein said first support includes a recess on a lower free end of said ring belt, said first support facing axially away from the top of said piston head.

3. The oil-cooled piston according to claim 2, wherein said second support includes an annular step extending around the circumference of said bosses facing axially toward the top of the piston head.

4. The oil-cooled piston according to claim 3, wherein said annular plate includes an outer edge supported in said recess and an inner edge supported on said step, wherein said annular plate exerts axial force against said recess and said step.

5. The oil-cooled piston according to claim 4, wherein each part of said annular plate has a bore formed therethrough for feeding and discharging oil to and from said annular cooling oil duct.

6. The oil-cooled piston according to claim 4, wherein said annular plate has two bores, each bore being formed through both parts jointly for feeding and discharging oil to and from said annular cooling oil duct.

7. The oil-cooled piston according to claim 1, wherein the opening of said cooling oil duct faces in the axial direction away from said piston top.

8. A method for closing an annular cooling oil duct in a piston head for an internal combustion engine, the piston head having a longitudinally extending axis and a top end, said method comprising the steps of:

(a) providing a piston head with a first support, facing in an axial direction, recessed in a free end of a downwardly extending ring belt and a second support facing in an opposite axial direction located on the piston head bosses;

(b) dividing an annular plate into two parts;

(c) placing the outer edge of one part of the annular plate on the free end of the ring belt;

(d) pushing the inner edge of said annular plate part past said bosses to a position on said second support;

(e) snapping the outer edge of said annular plate part under axial tension onto said first support; and (f) repeating said steps of (c) placing the outer edge, (d) pushing the inner edge, and (c) snapping the outer edge with the other part of the annular plate.

9. The method as claimed in claim 8, wherein said annular plate comprises a pair of semiannular plates placed individually and together forming an annular plate.

10. The method as claimed in claim 9, further comprising the steps of forming bores through said annular plate for feeding and discharging oil to and from said annular cooling oil duct.

* * * * *